US006216316B1

(12) United States Patent
Errichiello

(10) Patent No.: US 6,216,316 B1
(45) Date of Patent: Apr. 17, 2001

(54) HINGE

(76) Inventor: Dominic R. Errichiello, 24 E. Thorndale, Roselle, IL (US) 60172

( * ) Notice: Subject to any disclaimer, the term of this patent is extended or adjusted under 35 U.S.C. 154(b) by 0 days.

(21) Appl. No.: 09/332,350

(22) Filed: Jun. 14, 1999

(51) Int. Cl.[7] ..... E05D 7/04
(52) U.S. Cl. ..... 16/246; 16/245; 16/388
(58) Field of Search ..... 16/245, 246, 254, 16/225, 235, 255, 381, 388, 259, 240, 241

(56) References Cited

U.S. PATENT DOCUMENTS

| | | | | |
|---|---|---|---|---|
| 30,970 | * | 12/1860 | Johnson | 16/388 X |
| 3,390,419 | * | 7/1968 | Foltz | 16/380 |
| 3,441,975 | * | 5/1969 | Shepherd | 16/255 |
| 3,754,300 | * | 8/1973 | Shepherd | 16/255 |
| 4,057,873 | * | 11/1977 | Bursani | 16/388 |
| 4,135,273 | * | 1/1979 | Holmes | 16/388 X |
| 4,719,666 | * | 1/1988 | Rios et al. | 16/381 X |
| 4,878,266 | * | 11/1989 | Cubides | 16/225 |
| 5,555,605 | * | 9/1996 | Mosher | 16/238 X |
| 5,755,011 | * | 5/1998 | Green et al. | 16/238 |

* cited by examiner

*Primary Examiner*—Robert J. Sandy
(74) *Attorney, Agent, or Firm*—Douglas B. White

(57) ABSTRACT

There is provided a hinge design which includes: (1) an alignment edge along each leaf of the hinge for aligning the hinge during installation, (2) a tapered pin with a bulbous extremity for easier installation, (3) a cam device in the form of a threaded insert positioned in a leaf of the hinge for affecting the adjustment of the hinge to correct the hang of the door, and (4) a security tab for interlocking the leaves of the hinge to prevent removal of the door when the pin is pulled from the knuckles. As an alternative secure design, the hinge is formed with a flexible plastic region between the leaves to function in place of the knuckle/pin combination and thereby prevent separation of the leaves.

12 Claims, 3 Drawing Sheets

FIG. 3
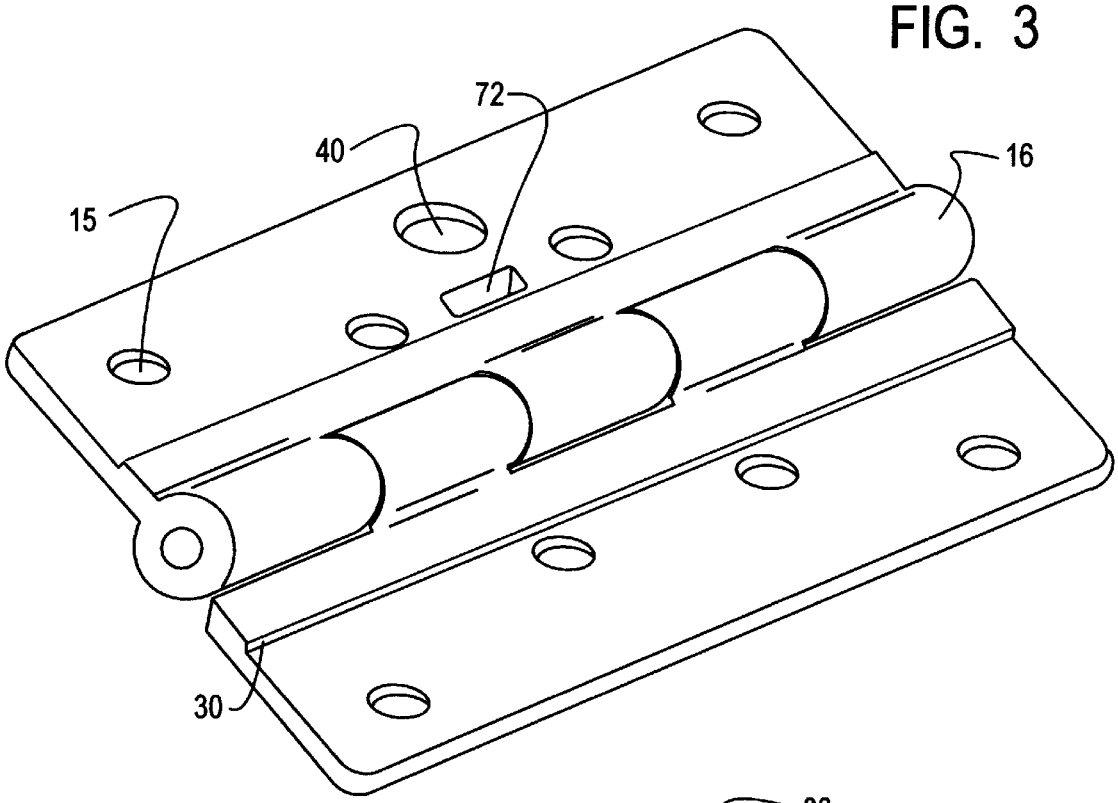
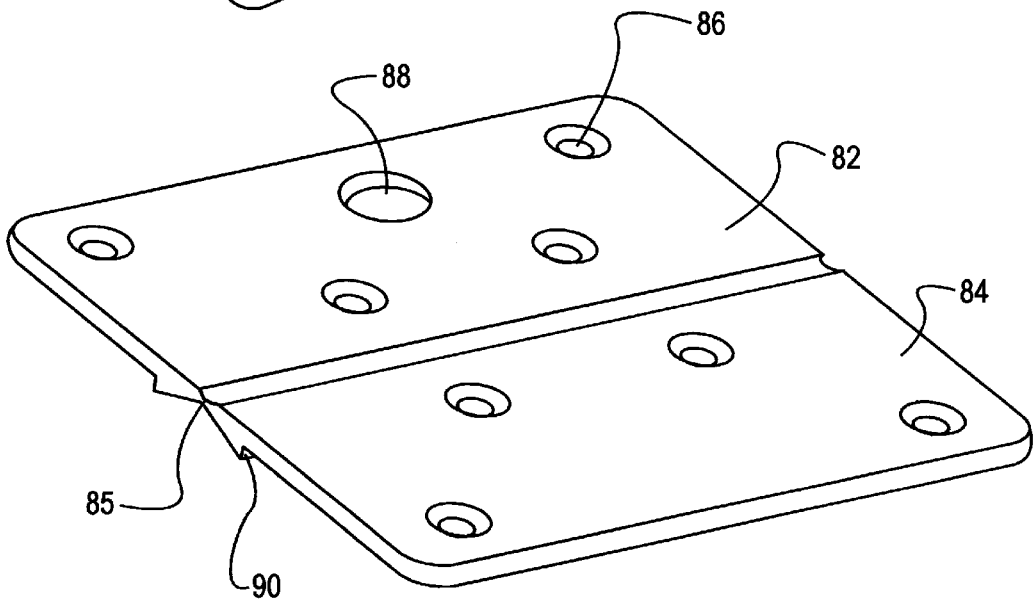
FIG. 4

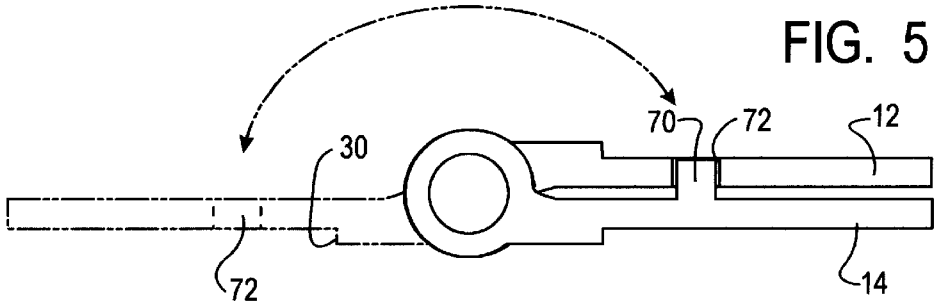
FIG. 5
FIG. 6
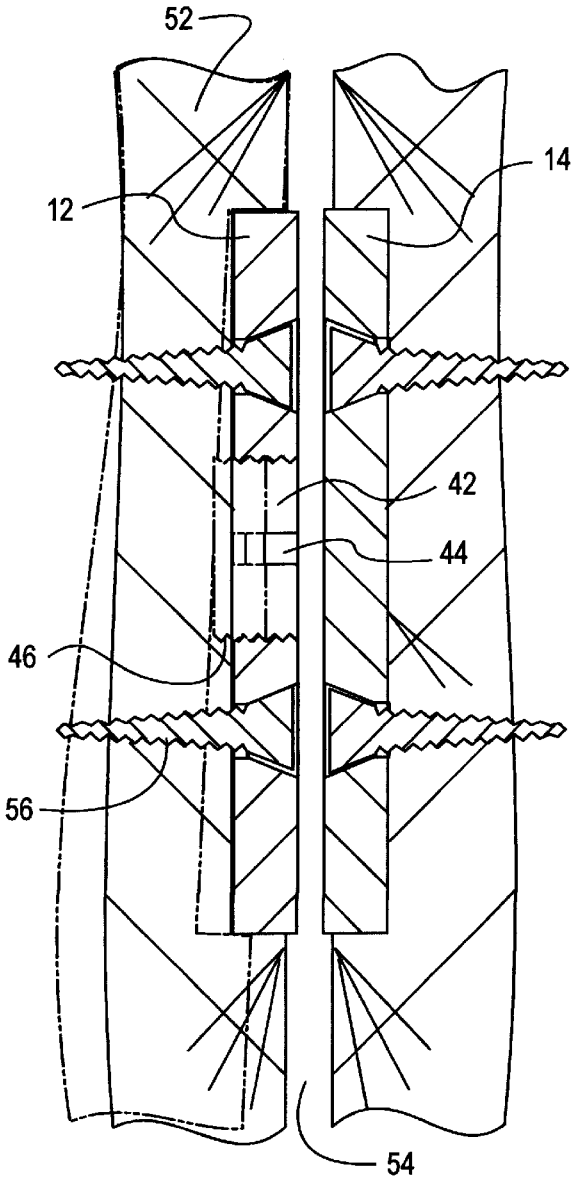
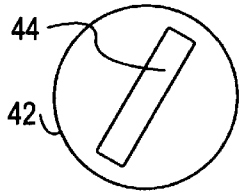
FIG. 7
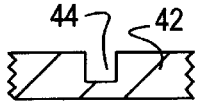
FIG. 8
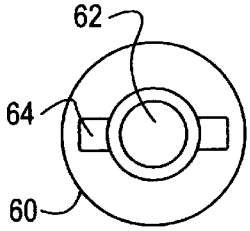
FIG. 9
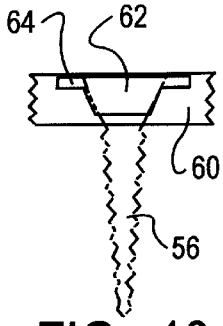
FIG. 10

HINGE

CROSS REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

1. Field of the Invention

The present invention relates generally to hinges used on doors (commonly referred to as butt hinges or leaf hinges) and more particularly relates to an improvement in such hinges which facilitate its installation, adjustment and operation.

2. Description of the Prior Art

Prior art hinges for use on doors generally present a leaf for screw attachment to a door and a leaf for screw attachment to a door jam. The two hinge leaves are joined by knuckles having a pin inserted therethrough. This prior art design has over the years proved to be difficult to align during installation and presents no means for adjustment after it is installed. Moreover, when the pin is removed, the door can be removed, and in some circumstances this presents a security problem.

SUMMARY OF THE INVENTION

Accordingly, it is an objective of this invention to present a hinge design which is easier to install and which includes an adjustment device for correcting the door alignment following installation. It is a further objective to present a security feature for preventing removal of a closed door when the hinge pin is removed; and alternatively, a secure hinge design is presented which functions without a hinge pin.

These and other objectives are accomplished by a hinge design which includes: (1) an alignment edge along each leaf of the hinge for aligning the hinge during installation, (2) an improved pin design having a taper and a bulbous end for easier installation, (3) cam devices in the form of threaded inserts positioned in the leaves of the hinge for affecting the adjustment of the hinge to correct the hang of the door, and (4) a security tab for interlocking the leaves of the hinge to prevent removal of the door when the pin is pulled from the knuckles. An alternative a variation of the hinge design is formed with a thinned flexible plastic region between the leaves to function in place of the knuckle/pin combination.

BRIEF DESCRIPTION OF THE DRAWINGS

FIG. 3 is a perspective view of the reverse side of the hinge of FIG. 1 showing the hinge alignment guides.

FIG. 4 is a perspective view of an alternative plastic embodiment of a hinge in accordance with the present invention.

FIG. 5 is a cross sectional view of the hinge of FIG. 1 showing the operation of the interlocking security tab feature.

FIG. 6 is a cross sectional view of the hinge of FIG. 1 showing it mounted to a door and door jam and showing the cam adjustment feature.

FIG. 7 is a top view of the cam insert member for the cam adjustment feature of FIG. 6.

FIG. 8 is a cross sectional view of the cam insert member for the cam adjustment feature of FIG. 6.

FIG. 9 is a top view of a second embodiment of the cam insert member for the cam adjustment feature of FIG. 6 which combines an anchoring hole with the cam adjustment feature.

FIG. 10 is a cross sectional view of the second embodiment of the cam insert member of FIG. 9.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
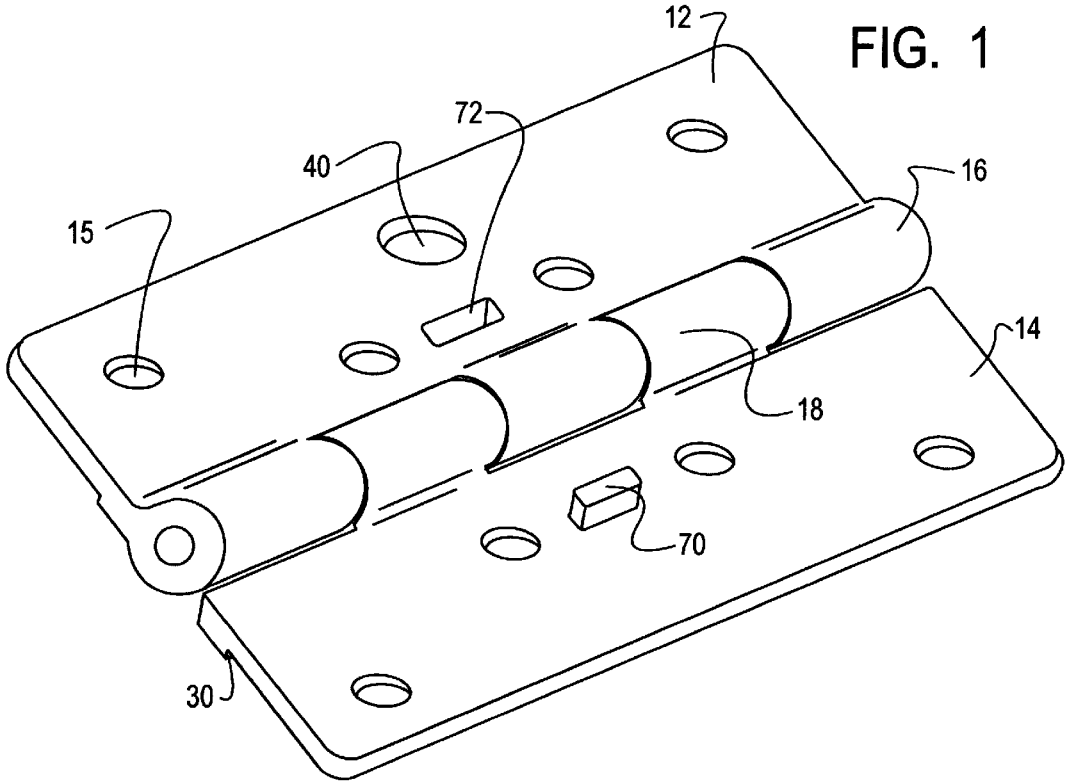
FIG. 1 is a perspective view of a hinge in accordance with the present invention.
Figure 2:
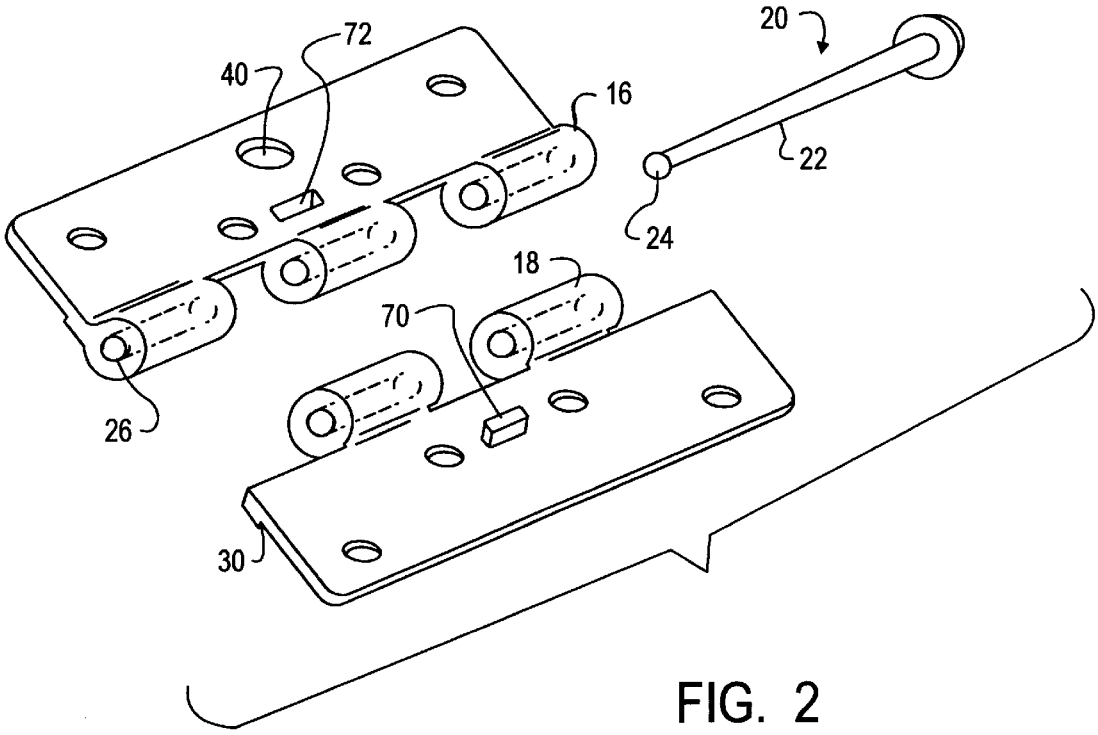
FIG. 2 is an exploded view of the hinge of FIG. 1 showing the tapered pin design.

Turning first to FIG. 1 there is shown a first embodiment of a hinge, in accordance with the present invention, having a first leaf 12 and a second leaf 14. Holes 15 in each leaf allow for mounting screws to attach the hinge to the door and door jam. Joining the leaves are knuckles 16 and 18 respectively positioned along one edge of each leaf. These knuckles are circular in cross section and arranged to interleave and to accept a joining pin 20 (FIG. 2), thereby securing the leaves of the hinge together.

In a first feature of the improved hinge of the present invention, there is provided a tapered shaft 22 of the pin 20 and a bulbous extremity 24 which is slightly larger than the terminus 26 of the knuckle openings. Insertion of the pin is accomplished by forcing the bulbous end of the pin through the tight terminus 26 of the knuckle openings, and once pushed through, the bulbous extremity 24 catches on the edges of the terminus 26 of the knuckle openings and resists removal. To effect removal, a tap on the bulbous extremity of the pin easily moves it past the terminus of the opening and leaves the pin free of the knuckles, due to its tapered shaft.

In a second feature of the improved hinge of the present invention, there is provided an alignment guide 30 (see FIG. 3) on each leaf for aiding in the installation of the hinge. This alignment guide may comprise a notch, tab, line or indicia for positioning the hinge on the door and door jam; but in the preferred embodiment this alignment guide consists of a protruding edge exhibited along each leaf. During installation the alignment guides are positioned along the edges of the door and door jam respectively, thereby aligning the hinge precisely while it is mounted.

In a third feature of the improved hinge of the present invention, there is provided cam means for adjusting the hinge position relative to its mounting after installation. Generally this cam means provides for spacing of the hinge leaf from its mounting surface by utilizing a cam-like device. Particularly, one or more threaded holes 40 (See FIG. 1 and FIG. 6) are provided in at least one of the leaves of the hinge for receipt of a threaded cam insert member 42 (FIGS. 7 and 8). This cam insert member is of the same thickness as the hinge leaf and includes a slot 44 in its accessible extremity for applying rotational force thereto. As shown in FIG. 6, rotation of the threaded cam insert member causes it to protrude 46 through the hinge leaf and to contact the surface of the mounting structure 52 (either the door or door jam). This in turn forces the leaf 12 away from its mounting surface and causes the spacing 54 between the door and door jam to thereby be increased. (Note that the mounting screws 56 are loosened before making this adjustment and are then re-tightened afterward.)

In an alternative version of the cam insert member, the mounting hole and the threaded hole for the cam insert member may be combined. As shown in FIGS. 9 and 10, this alternate cam insert member 60 includes a counter-sunk hole 62 for receipt of a mounting screw therethrough and a slot 64 for applying rotational force to the cam insert member. This cam insert member may be used at any mounting hole location by enlarging the hole and providing a mating thread therein for the cam insert member. Alternatively, the threaded hole 40 for the cam insert may be converted to an additional mounting hole by use of this alternative cam insert member. In either case the mounting screws are first loosened, as before, and the cam insert member rotated to cause its desired protrusion from the hinge leaf. The mounting screws, including one through the cam insert, are then re-tightened.

Turning now to FIGS. 1 and 5, there is depicted a fourth feature of the improved hinge of the present invention. A security tab 70 protrudes from one leaf of the hinge and is positioned in mating alignment with a hole 72 in the opposing leaf. As best shown in the cross sectional view of FIG. 5, when the hinge is closed with the leaves positioned together, the tab 70 protrudes into the hole 72 to thereby interlock the leaves. Consequently, when the pin is removed the door cannot be removed from the door jam with out first opening the door.

As an alternate embodiment of the improved hinge of the present invention, there is shown in FIG. 4 a secure hinge having a first leaf 82 and a second leaf 84 defined thereon. These leaves may be constructed of any material but in the preferred embodiment they are molded plastic. In place of the knuckle/pin device of the prior embodiment, there is provided a thinned flexible plastic portion 85 joined to the leaves and bridging between the leaves to allow the required hinging motion. By the judicious choice of a tough but flexible plastic, this plastic hinge functions equally as well as the knuckle/pin device, yet allows greater manufacturing options. The leaves are mounted to the door and door jam by means of mounting screws through the mounting holes 86, as described with the first embodiment, and a cam adjustment feature is similarly provided which includes a threaded hole 88 for the cam insert member. Alignment guides 90 in the form of defined edges along each leaf are also provided, as previously described. Mounting and adjustment of the hinge is the same as the above described first embodiment, with the obvious exception of the use of the joining pin/knuckle device which has now been replaced by the plastic hinge. The alternate embodiments of the threaded cam insert member are equally applicable here, allowing for either a dedicated cam adjustment insert or the combined mounting screw and cam adjustment insert.

From the foregoing description, it will be apparent that modifications can be made to the apparatus and method for using same without departing from the teachings of the present invention. Accordingly, the scope of the invention is only to be limited as necessitated by the accompanying claims.

What is claimed is:

1. A hinge comprising:

a first leaf having knuckles formed along one edge thereof and having a threaded hole defined therein;

a second leaf having knuckles formed along one edge thereof;

a pin member projecting through said knuckles of said first and second leaves; and a threaded insert member having an opening defined therein for receipt of a hinge anchoring screw therethrough, said threaded insert member being positioned in said threaded hole of said first leaf for selective rotation therein, whereby upon rotation said threaded insert member is caused to selectively protrude from said first leaf.

2. The hinge of claim 1 wherein said first and second leaves exhibit respective alignment guides thereon.

3. The hinge of claim 1 wherein said pin member comprises a tapered pin having a bulbous extremity thereon for securing said pin in said knuckles.

4. The hinge of claim 1 further comprising tab means for causing said first and second leaves to interlock.

5. A hinge comprising:

a first leaf having a defined edge thereon for use as an alignment guide and having knuckles formed along one edge of said leaf;

a second leaf having a defined edge thereon for use as an alignment guide and having knuckles formed along one edge of said second leaf;

a pin member projecting through said knuckles of said first and second leaves; and cam means mounted within one of said leaves for selective adjustment of the position of said respective leaf relative to a surface which it is to be mounted thereon, wherein said cam means comprises a threaded hole in said respective leaf and a threaded insert member positioned in said respective hole for selective rotation therein, whereby said insert member is caused to selectively protrude from said respective leaf to effect said adjustment.

6. The hinge of claim 5 wherein said insert member further comprises an opening defined therein for receipt of a hinge anchoring screw therethrough.

7. The hinge of claim 5 wherein said pin member comprises a tapered pin having a bulbous extremity thereon for securing said pin in said knuckles.

8. The hinge of claim 5 further comprising tab means for causing said first and second leaves to interlock.

9. A hinge comprising:

a first leaf having anchoring holes defined therein;

a second leaf having anchoring holes defined therein; and a thinned flexible plastic portion positioned between said first and second leaves for hingedly connecting said first and second leaves;

cam means mounted within one of said leaves for selective mounting adjustment of said respective leaf position, wherein said cam means comprises a threaded hole in said respective leaf and a threaded insert member having an opening defined therein for receipt of a hinge anchoring screw therethrough, said threaded insert member being positioned in said respective threaded hole for selective rotation therein.

10. The hinge of claim 9 wherein said first and second leaves each exhibit an alignment guide thereon.

11. The hinge of claim 9 wherein said pin member comprises a tapered pin having a bulbous extremity thereon for securing said pin in said knuckles.

12. The hinge of claim 9 further comprising tab means for causing said first and second leaves to interlock.

* * * * *